US005257784A

United States Patent [19]

Boylan et al.

[11] Patent Number: 5,257,784

[45] Date of Patent: Nov. 2, 1993

[54] WAGERING GAME

[75] Inventors: Eugene B. Boylan, Zephyr Cove; Anthony J. DeLise, Minden; Robert F. Koerner, Gardnerville, all of Nev.

[73] Assignee: Bet Technology, Inc., Carson City, Nev.

[21] Appl. No.: 822,879

[22] Filed: Jan. 21, 1992

Related U.S. Application Data

[63] Continuation-in-part of Ser. No. 667,227, Mar. 11, 1991, Pat. No. 5,098,107.

[51] Int. Cl.[5] ..... A63F 3/06

[52] U.S. Cl. ..... 273/138 R; 273/144 B; 273/269

[58] Field of Search ..... 273/138 R, 292, 269, 273/274, 309, 306, 303-305, 144 R, 144 A, 144 B

[56] References Cited

U.S. PATENT DOCUMENTS

| | | | |
|---|---|---|---|
| 1,361,202 | 12/1920 | Thomas | 273/306 |
| 3,904,208 | 9/1975 | Grossman | 273/146 |
| 3,998,462 | 12/1976 | Goott | 273/274 |
| 4,222,572 | 9/1980 | Baker | 273/306 |
| 4,273,335 | 6/1981 | Allonsius | 273/144 B |
| 4,659,087 | 4/1987 | Shen et al. | 273/274 |
| 4,836,553 | 6/1989 | Suttle et al. | 273/292 |
| 4,861,041 | 8/1989 | Jones et al. | 273/292 |
| 4,948,134 | 8/1990 | Suttle et al. | 273/85 CP |

FOREIGN PATENT DOCUMENTS

| | | | |
|---|---|---|---|
| 991386 | 5/1965 | United Kingdom | 273/274 |

OTHER PUBLICATIONS

Games & Puzzles, Gamesview: Bridgette, p. 18, Feb. 1976, Found in Group 330 Search Room.

*Primary Examiner*—Benjamin H. Layno
*Attorney, Agent, or Firm*—Larson & Taylor

[57] ABSTRACT

A method and apparatus for playing a wagering game include a usual play of the game whose outcome is determined by a selection of usual randomly generated symbols. Added to the usual symbols is at least one and preferably a plurality of additional, preferably no-value, symbols. The wagering game is then played by wagering on the usual play of the game and additionally by wagering on a chance occurrence of one and preferably at least two of the additional symbols being selected during the usual play. The wages on the chance occurrence are settled according to the outcome of the chance occurrence, and the usual wagers are similarly settled depending on the outcome of the usual play of the game. In one preferred embodiment, the wagering game is a usual card game so that the usual chance generated symbols are a deck of value playing cards. The additional symbols are then at least two no value playing cards which are added to the deck. In other embodiments, the usual symbols are representations of such cards, numbers, or other symbols of significance. Besides dealing of the symbols, the use of ball and grid selection devices, an electronic selection device with a video display, or a lottery mixing and picking device are possible

14 Claims, 10 Drawing Sheets

142
144
148
CHANCE CARD - DRAW POKER
150
152
149
6
9
GOLD
J
150
164
CHANCE BET PAYOFF
2 GOLD PAY_TO 1
2 SILVER PAY_TO 1
2 BRONZE PAY_TO 1
172
SPECIAL CHANCE BET JACKPOT
2 PLATINUM PAYS
180
CHANCE CARD
INSERT 0 TO 5
WIN
IF NEXT CARD IS
A CHANCE CARD
161
170
163
CHANCE BET=5
160
BET = 4
BANKROLL = 15
156
153
174a
174b
174c
174d
174e
154
HOLD
HOLD
TOKENS
178
PAYOUT
PLAY CREDIT
MAX CREDIT
DEAL
162
158
159
162
146

WAGERING GAME

This application is a continuation-in-part application of U.S. application Ser. No. 667,227 filed Mar. 11, 1991, now U.S. Pat. No. 5,098,107.

FIELD OF THE INVENTION

The present invention relates generally to games using symbols in which a wager is made, and more particularly to such games where one or more additional symbols are added and an additional wager while playing the game is made using the additional symbols.

BACKGROUND OF THE INVENTION

Games in which wagers are made based on the outcome of randomly (chance) generated or selected symbols have wide appeal. Such games include various card games as well as other games where there are randomly generated or selected symbols. In order to increase interest in the game, variations to games have been proposed.

For example, in U.S. Pat. Nos. 4,836,553 and 4,948,134 (Suttle et al.), a modified (for casino play) poker game is disclosed in which each player plays against a dealer. If the player wins, he receives a bonus payment depending on the poker rank of his hand. Both a live version and an electronic version of the game are disclosed.

In U.S. Pat. No. 4,222,572 (Baker), a card deck is disclosed which includes high and low red and black cards. The high cards have indicia thereon so as to be distinguished from the low cards which do not. High cards of a third color are also provided. With this simplified deck, various card games are possible. For example, a player can bet on which card will next be dealt. For this purpose, a suitable game board is also disclosed.

A modified blackjack or 21 game utilizing an additional bet has been licensed by Gaming Concepts, Inc. of Long Beach, California. In this game, the players may bet not only on the outcome of their hand against the dealer, but they may also bet on whether their first two cards total more or less than thirteen.

While various games have been disclosed to increase interest in a game or to create a new game to generate interest, there has been a need to provide present games with simple and interesting variations to both create additional interest as well as increase wagering opportunities (and hence interest).

SUMMARY OF THE INVENTION

In accordance with the present invention, a method and apparatus for playing a wagering game are provided. The wagering game includes a usual play of the game whose outcome is determined by a selection of usual randomly generated symbols. Added to the usual symbols is a plurality of additional symbols. The wagering game is then played by wagering on the usual play of the game and additionally by wagering on a chance occurrence of at least two of the additional symbols being selected during the usual play. The wagers on the chance occurrence are then settled depending on the outcome of the chance occurrence, and the usual wagers are also settled depending on the outcome of the usual play of the game.

In one embodiment, the wagering game is a usual card game with the chance generated symbols being a deck of value playing cards. Thus, to the deck of value playing cards at least two additional no value playing cards are then added. These additional no value playing cards are marked differently on the value side from the value playing cards in order to be easily identified. During play, the cards are dealt and the chance wager can be made on whether two of the additional cards will be dealt consecutively during the usual playing.

In one method of play, the chance wagering is made after an additional card is dealt. Alternatively, the chance wager can be made before any cards are dealt. In either event, after an additional card is dealt, further cards are dealt until a value card is dealt to replace the initially received additional card, so that the additional card or cards dealt can be discarded and the usual game continued. As a further alternative, the receiving player of an additional card can be presented with a choice of using the additional card as a wild card or of making a chance wager on whether or not the next card which will be dealt to him will be another additional card. In a casino type game, this choice can be accompanied with the requirement that a receiving player desiring to use the additional card as a wild card buy the additional card.

In another embodiment of the present invention, the additional cards come in at least two designations. Then, the chance wagering step can include the wagering on whether another additional card of any designation will be dealt after a first is received, or whether another additional card of the same designation will be received. Obviously, the payoff for receiving two same designation additional cards would be greater than for receiving any two additional cards.

As an added incentive to the making of a chance wager, according to a further preferred embodiment of the present invention, a chance fund is initially set up. Then, the settling step includes the paying out of a predetermined amount of the chance fund when a participant wagers a chance bet and two additional cards are dealt consecutively. Where the participants of the game include at least one player in a house, the chance fund can be set up by the house and a predetermined amount of any chance bet from a previous game collected by the house is added to this chance fund. Alternatively, an ante can be collected from each participant and added to the chance fund.

In one particular method of play, a chance wager is made only by the receiving player. In another, both the receiving player and other players can make a chance wager after an additional card is dealt to the receiving player. Such wagers, where there are additional cards of first and second designations, can also be either to two consecutive additional cards of any designation or two consecutive additional cards of a same designation.

In still another method of play of the present invention, the playing step includes the further step of wagering prior to the dealing step on the initial receipt of a predetermined association of the first two value cards received by that participant. Such an association can include a predetermined sequence and/or, where value cards of the deck are provided in a plurality of suits, the receipt of two value cards of the same suit.

When cards are employed as the chance generated symbols, the wagering game is preferably selected from one of 21, poker, baccarat, or pai gow.

In another preferred embodiment of the present invention, the usual randomly generated symbols are laid out on a surface with a confining border around the usual symbols and a separating means for separating each usual symbol from the surrounding symbols. The adding step then includes the step of designating a plurality of the usual symbols as additional symbols. Then, the playing step includes the steps of bouncing balls inside the border and the stopping of the balls on top of respective usual symbols to determine the selected usual symbols. The chance settling step is then accomplished as required by whether any of the selected symbols are also designated as additional symbols. If desired, a chance fund can also be set up and the additional symbols can be first and second designations.

In still another preferred embodiment of the present invention, the usual symbols are provided on a video display screen as part of an electronic game device. The additional symbols are thus added to the usual symbols of the video display screen and the electronic game. The playing step then includes the steps of registering a usual wager into the game device, registering a chance wager into the game device, and actuating of the usual play of the game device. Depending on the outcome of the usual play, the game device then performs the settling step by suitably registering that credit including winnings of wagers in the game device and paying out the credits if desired.

Preferably, the randomly generated symbols of the electronic game are representations of a deck of value playing cards to which at least two additional no value playing cards having different representations have been added. The playing steps then includes the dealing of the representative cards on the video display screen. Other variations similar to the usual card games above are also possible with this video electronic game.

In still another preferred embodiment of the present invention, a method of playing a wagering game whose outcome is determined by a selection of usual randomly generated symbols of that game comprising the steps of adding to the usual symbols at least one additional symbol. Then, a playing of the game by at least one participant includes wagering on a usual play of the game, and wagering on a chance occurrence of the at least one additional symbol being selected during the usual play. Subsequent to these wagering steps, a plurality of the symbols are randomly selected to determine a usual outcome of the game. Finally, the wagers of the chance occurrence of the additional symbol being included with the selected symbols is settled and the wagers of the usual play of the game are also settled.

In a preferred method of playing this wagering game, the usual wagering step includes the step of the choosing of a set number of certain of the usual symbols and the wagering that these certain symbols will be selected. Then, the selecting step includes the selecting of the set number plus the number of additional symbols available to be selected.

In the preferred method, the adding step includes the step of mixing into the usual symbols at least two additional no value symbols, and the chance wagering step includes the wagering on whether two additional symbols will be selected. In addition, the participants of the game are preferably at least one player and a house against which each player wagers, and the settling steps are performed by the house.

The apparatus of the present invention includes the usual symbols and additional symbols, as well as a display means for displaying the symbols as they are played. The display means also includes a usual wagering means for wagering on a usual play of the game and a chance wagering means for wagering on a chance occurrence of at least two of the additional symbols being displayed. Settling means for the chance and usual wagers are also provided.

In one preferred embodiment of the apparatus, the randomly generated symbols and additional symbols are cards and the displaying means is a surface. The wagering means then includes indicia located on the surface on which a wagering token is placed to indicate the wager made. The settling means can include a bank means for storing a plurality of the wagering tokens.

Where the additional cards include at least two no value playing cards of a first designation and at least two no value playing cards of a second designation, the chance wagering means includes indicia indicating a first payoff for the making of a chance wager for the second consecutive dealing of an additional card and a second payoff for the making a chance wager for another additional card of the same designation being next dealt.

The chance settling means can include indicia on the surface on which a chance fund is created by the placing of wagering tokens thereon. When a participant wagers a chance bet and two additional cards are then dealt consecutively, a predetermined amount of the chance fund is paid out.

The display means can further include an association wagering means for wagering prior to the dealing of the cards on the initial receipt of a predetermined association of two value cards. The association can be a predetermined sequence and/or, where the cards have suits, the receipt of two cards of the same suit.

In another embodiment, the symbols are laid out in a container with a confining border and with a separating means between each of the usual symbols. Some of these usual symbols are additionally designated as additional symbols. The display means then includes a plurality of balls which are bounced inside of the border and which stop on top of respective usual symbols to determine the selected usual symbols and any selected additional symbols.

In an alternative embodiment, the display means includes an electronic game device having a video display screen. The electronic game includes registering means for a usual wager and for a chance wager. The settling means then includes a registering means for indicating net credits including any winning wagers and a payout means for the paying out of the game device of the net credits.

Preferably, the generated symbols are representations of a deck of value playing cards and a display means represents the dealing of the represented cards on the video display screen. Representative games would be 21, poker, baccarat, and pai gow.

It is an object of the present invention to provide a wagering game which generates increased interest and participation.

It is also an object of the present invention to provide a wagering game with increased opportunities to wager in addition to those found in a usual wagering game.

It is another object of the present invention to provide a wagering game which achieves the above-noted objects and in addition is simple and easily understood as an addition to a usual wagering game.

Other features and objects of the present invention are stated in or are apparent from a detailed description of presently preferred embodiments of the invention found hereinbelow.

DETAILED DESCRIPTION OF THE PREFERRED EMBODIMENTS

Figure 1:
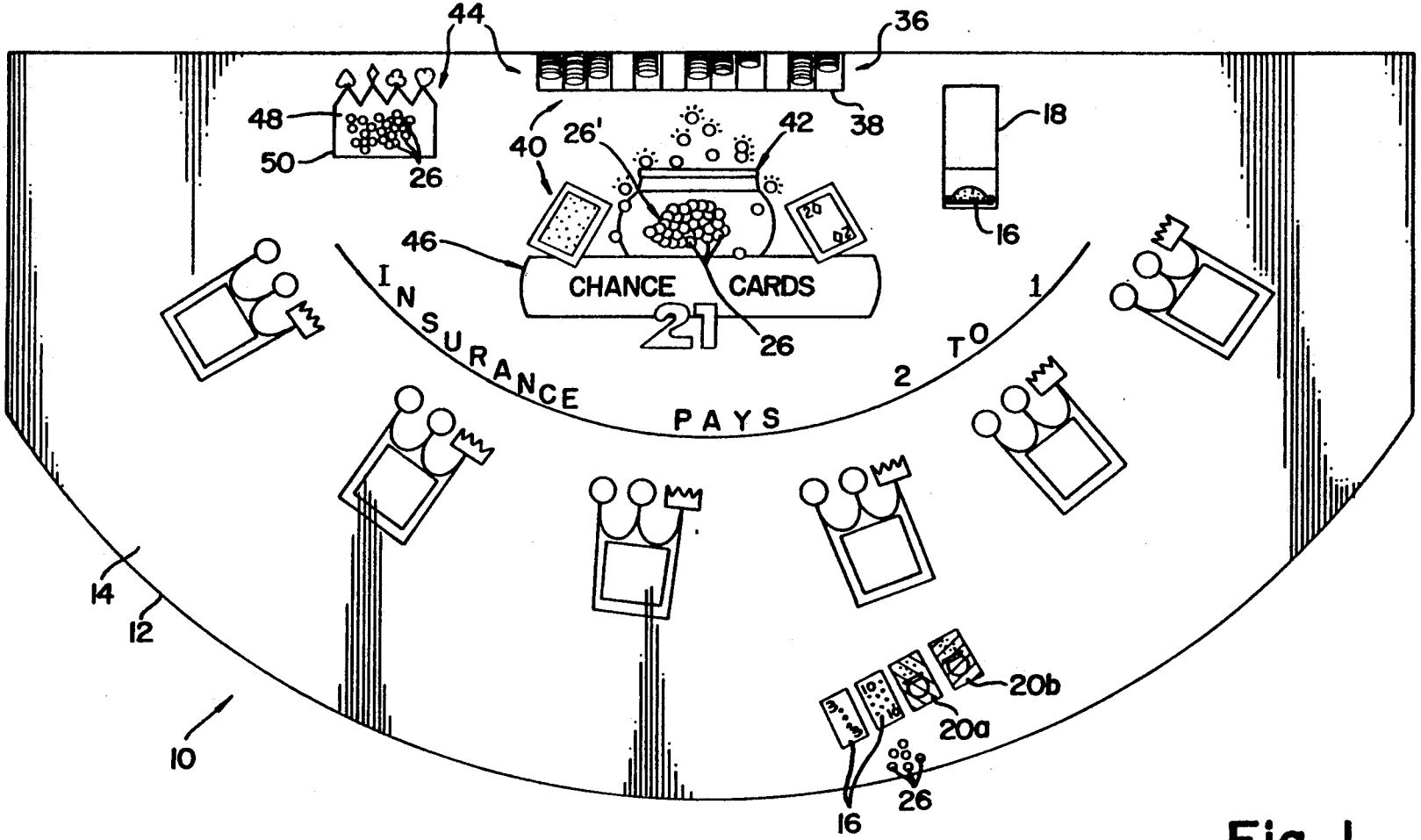
FIG. 1 is a schematic representation of a display surface for a 21 wagering game of the present invention.

With reference now to the drawings in which like numerals represent like elements, a playing system 10 is depicted in FIG. 1 for playing a wagering game in accordance with the present invention. Playing system 10 includes a display means 12 for this wagering game. It should initially be appreciated that playing system 10 is adaptable for use either as a casino operator's live action table or as a home playing board. Thus, display means 12 could either be a top surface of a table and thus serve as a permanent structure for a live action table game or as a board, sheet, or velcro elements for use in a portable home game. As such, it will be appreciated that display means 12 in all cases includes a surface 14 which is viewable by the various participants (player(s), dealer, and/or house).

Playing system 10 is designed, in this particular embodiment, to provide for the playing of a usual game of 21 or blackjack. As such, playing system 10 includes the usual symbols for the 21 game, that is a plurality of value playing cards 16. For convenience, and as is typical in a live action game, playing cards 16 are contained in a shoe 18 which contains a number of decks of playing cards 16 all mixed together so that as the cards are dealt each dealt card is randomly generated. The cards are dealt face up with the exception of a hold card for the dealer.

In addition to the usual symbols of the game (playing cards 16), a plurality of additional symbols are added to the usual symbols. In this embodiment, the additional symbols are at least two no value playing cards 20*a* and 20*b*. As shown in FIG. 1, no value playing cards 20*a* and 20*b* are easily identifiable (on the value side, the other side of all cards being the same), such as by suitable indicia provided thereon. Further, in a preferred embodiment of playing system 10, no value playing cards 20*a* and 20*b* also come in variety of colors, such as gold and silver (which different colors are shown in FIG. 1 by different cross hatching).

As well known, the usual 21 game provides a wagering opportunity between the participants (typically a number of players each playing against a dealer) on who will be closer to the sum of 21 without exceeding the sum of 21. In order to provide a usual wagering means 22 for making such a wager, surface 14 is provided with an indicia 24 on which a wagering token 26 (such as a chip, money, coin, bill, paper, or other item chosen to have a value) is placed to indicate that a usual wager has been made. As shown best in FIG. 2, indicia 24 is a circle with the lettering "21 bet" contained therein. Before commencing each hand, as in the usual 21 game, each player is required to place a wagering token 26 in the usual wagering means 22 to indicate that that player is participating in the next hand.

As mentioned above, a plurality of no value playing cards 20*a* and 20*b* are mixed with regular value playing cards 16. Display means 12 thus also includes a chance wagering means 28 including indicia 30 whereby each player can also wager by the placing of a suitable wagering token 26 on indicia 30 that two no value playing cards 20*a* and/or 20*b* will be dealt consecutively during that hand or round of play.

In this embodiment of playing system 10, display means 12 further include an association wagering means 32 including indicia 34. Association wagering means 32 is used to make a wager by the placing of suitable wagering token 26 thereon when a player desires to also wager that the first two playing cards 16 dealt to that player will have some predetermined association. In this embodiment, as indicated by indicia 31, the predetermined association is for two cards of the same suit or for a "king" and "queen".

As playing system 10 depicted in FIG. 1 is designed for a 21 game having a dealer and from 1 to 6 players, each player thus plays against the dealer. The dealer is therefore supplied with a usual settling means 36 which in this embodiment takes the form of a bank 38 of wagering tokens 26 (which are conveniently of various denominations as desired). Thus, if the player loses, the player settles or pays by the loss of his wagering tokens 26 placed on indicia 24, typically by the collection of such tokens 26 by the dealer and placing of these tokens 26 into bank 38. Conversely, if the player wins against the dealer, the dealer simply settles or pays the player from tokens in bank 38.

Figure 2:
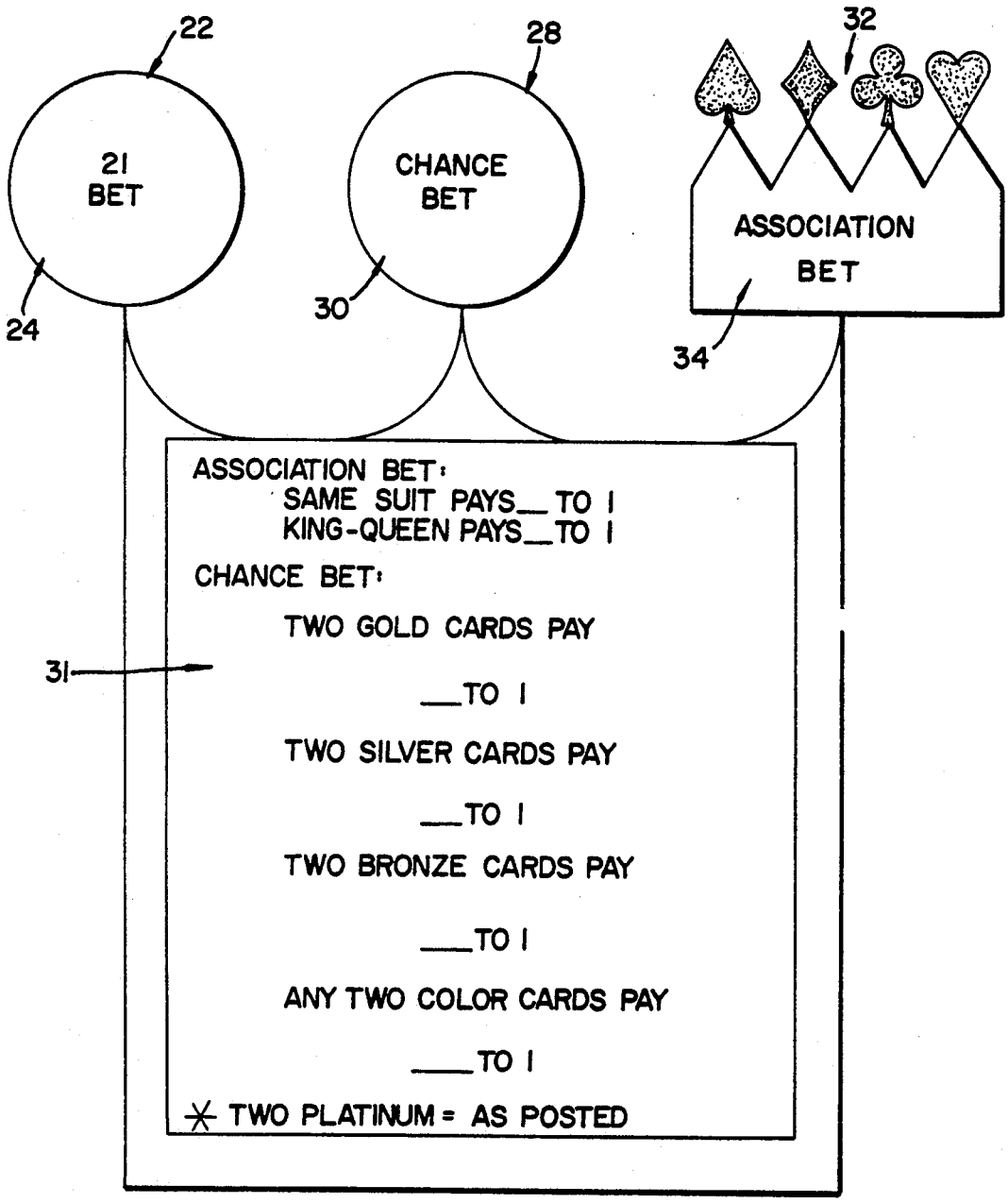
FIG. 2 is an enlarged view of one of the wagering indicia shown in FIG. 1.

In order to pay off chance wagers made on indica 30, a chance settling means 40 is also required. With playing system 10, chance settling means 40 includes bank 38 as well as an indicia 42 on which a plurality or pot 26' of tokens 26 is provided. Depending on the method of playing the 21 game (different versions are discussed subsequently), all or some portion of tokens 26 in pot 26' contained on indicia 42 are paid to a player making and then winning a chance bet. Where the player loses a chance bet, tokens 26 placed on indicia 30 are then preferably collected by (settled to) the dealer and added to bank 38 and/or chance settling means 40. It should be appreciated that the provision of a separate chance settling means 40 is desired to stimulate interest in a chance bet, but that chance settling means 40 could also simply include bank 38 without the necessity for a separate pot 26' of tokens 26 provided on indicia 42.

Where the chance settling means includes bank 38 and does not make use of pot 26' of tokens 26 at indicia 42, suitable indicia 31 is provided indicating payoffs for the various chance bets available. Indicia 31 is provided adjacent wagering means 22, 28, and 32 as depicted in FIG. 2. Indicia 31 thus shows payoffs for various no value playing cards combinations, and in FIG. 2 it is further evident that no value playing cards include bronze cards as well as gold and silver cards 20*a* and 20*b*.

Where an association bet is made with association wagering means 32, an association settling means 44 simply takes the same form as usual settling means 36. Thus, settling is accomplished as losing bets are collected by (paid off to) the dealer and applied to bank 38 while winning bets of the player are paid from bank 38.

To further stimulate interest in making a chance wager in casinos and the like, a progressive chance jackpot (not shown) could also be used. Such a progressive jackpot could be funded by the pooling of a small percentage of all lost chance wagers from a number of tables. Thus, the progressive jackpot would become increasing large (until won), and all players at the various tables would be eligible to make a chance wager to win this progressive jackpot. Preferably, the value of the progressive jackpot would be posted at various places for the players to see, as indicated in indicia 31. This would conveniently be done using video displays, which could be continuously updated by meters which the dealer at each table would continually update. To win the progressive jackpot, a player would have to receive two particular no value cards of an extremely rare type. For example, two no value cards of a platinum color could be mixed into six regular decks of value playing cards.

In some jurisdictions, it may also be required that some portion of any value of tokens 26 remaining in indicia 42 when a table closes be ultimately distributed to some wagering player(s). In such situations, the required portion of the value remaining in indicia could also be added to a progressive jackpot. Thus, the required portion would eventually be returned to a wagering player, as required. This could be done in addition to the adding of a portion of lost chance bets to the progressive jackpot, or as an alternative way of funding the progressive jackpot.

From the above description, it should be evident that a number of versions of a wagering game of the present invention based on a usual 21 or blackjack game is possible. With reference to FIGS. 1 and 2, some of these various versions will be discussed subsequently in detail. It will be appreciated that the variations occur within the usual playing of the 21 or blackjack game and the usual wagering thereon. Thus, as a prerequisite for participation, each player must initially wager a usual 21 bet, which is usually of a predetermined minimum amount.

VERSION 1

In a first version of the 21 wagering game of the present invention, chance wagering means 28 is utilized. When any player is dealt a no value playing card during normal play, normal play is momentarily suspended. The dealer then requests that any player desiring to make a chance wager place an appropriate wager (usually of a predetermined minimum) on indicia 30. After the wagers have been made, the next card is drawn from shoe 18. If it is another no value playing card, the players with bets are winners and the dealer pays off the winning bets as indicated by indicia 31. However, if it is not a no value playing card but rather a value playing card, the player who drew the original no value playing card then takes the value card in place of the no value card received. The dealer then collects all losing chance bets. In the preferred embodiment of playing system 10 and for the reason as discussed subsequently, half of all of the losing bets collected by the dealer are placed in bank 38 while the other half are added to pot 26' of tokens 26 in chance settling means 40. Thereafter, normal 21 play resumes until another no value card is dealt to a qualifying player.

It should be appreciated that a predetermined number of no value playing cards are mixed in with regular playing cards 16. For example, a minimum of two each of gold no value playing cards 20*a*, silver no value playing cards 20*b*, and bronze no value cards (not shown) are mixed in with each deck of playing cards 16 provided in shoe 18.

In this version, the dealer does not participate in the chance wagering sequence. Thus, if the dealer receives a no value card, it is immediately discarded and the dealer then draws a new card from shoe 18 until a value card is received. With this version, it will also be appreciated that the dealer must immediately check any down card received to make sure that it is not a no value card.

In order to stimulate participation in making chance bets, according to this version of the wagering game of the present invention, the player who receives the first no value card is also eligible to win pot 26' of tokens 26 provided in indicia 42 when that player does make a chance bet. The receiving player of a first no value card of a certain color, such as gold no value card 20*a*, by making a chance bet, can then win all of the tokens 26 in indicia 42 if the subsequent card dealt is a no value card of the same color, i.e. another gold no value card 20*a*. As mentioned above, half of all losing chance bets are added to pot 26' of tokens 26 in indicia 42, so that there is an increasing payoff should the receiving player make and win such a chance bet.

With this version, it should be appreciated that even if a player has already lost his 21 hand during that round of play, he is still able to make a chance bet when another player receives a no value card. Thus, the use of a chance bet helps to maintain the interest of all players in the entire round of play.

It should also be appreciated that as it is possible for a number of chance bets to be made during a round of play, all chance bets must be immediately paid or collected by the dealer before normal play resumes in case a no value card is subsequently dealt.

While there is no requirement that any player make a chance bet when a no value card is dealt, because the no value card has no value, it is also necessary that further cards be dealt to that same player until a value card is received in order to continue normal playing.

With this version, the dealer or house in a casino type game can determine minimum and/or maximum bets. Regular 21 insurance could also be used, if desired. Further, the chance bet payoffs may also be determined by the house or dealer as desired and as consistent with any local laws. It should also be appreciated that where ½ of losing chance bets are added to pot 26', it may be desirable to have special ½ value tokens. Thus, where a player makes an odd chance wager such as three tokens, it is possible for the house of dealer to easily add 1½ tokens to pot 26'. Obviously, players would not be permitted to make any wagers including only a single ½ token, and for convenience would preferably not be able to use any ½ tokens but would instead redeem any ½ tokens won in pot 26' for regular tokens.

In a home version of this type of game, there would be no house dealer and each player would deal in turn. While a player is dealing, the dealer would then not be eligible to make any chance wagers. Further, only the player receiving the no value card would have an opportunity to place a chance wager upon receipt of the first no value playing card. All lost chance wagers would be placed in a pot of tokens in a chance settling means to build up the chance settling means. When the game is first started or after the chance settling means has been depleted, an "ante" of a predetermined amount would be required from each player. In addition, where different matches of no value playing cards is possible, a predetermined percentage of the pot of tokens in the chance settling means would be won by a successful chance bet.

VERSION 2

In a second version of a wagering game of the present invention, the method of play is essentially the same as described in Version 1 above. However, in this version, the player receiving the first no value card can win pot 26' of tokens 26 in indicia 42 simply by receiving a second no value card of any color. Thus, in this version, no color match of no value cards is necessary to win pot 26' of tokens 26 in indicia 42.

VERSION 3

The method of playing this version of a wagering game according to the present invention is also basically similar to that of Version 1 above. However, in this version, there is no pot 26' of tokens 26 in indicia 42 and the payoffs for a chance bet are simply as indicated in indicia 31. In addition, if a no value card is received by the dealer, all players (the dealer is not considered a player) can make a chance bet at that time if desired. The next card from shoe 18 would then be dealt to the dealer and all chance bets made by the players would be settled depending on the card dealt just as in the case of a player receiving a no value card.

VERSION 4

In this version of a wagering game according to the present invention, the same method of play discussed above with respect to Version 1 applies. However, in this version, a player receiving a no value card would only qualify to win pot 26' of tokens 26 in indicia 42 if the receiving player makes a predetermined maximum chance wager. Then, if the receiving player subsequently receives a second no value card of the same color, the receiving player would win the entire pot 26' of tokens 26 in indicia 42. Otherwise, if the receiving player does not make the maximum wager or no wager at all, the payoffs would be as described above in indicia 31 in Version 1 for that player and the other players.

VERSION 5

In this version, the same method of play described above in Version 1 also applies. However, a player receiving a no value card must first make an election either to purchase the no value card at some predetermined price determined by the dealer or house. A purchased no value card can then be substituted for a value card in that player's hand at the player's discretion. When a no value card is purchased by a player in this manner, no chance bets are made, and usual play will continue with a new card being dealt from shoe 18 in the usual manner of play. Otherwise, the usual opportunities for chance wagering would occur if the card is not purchased by the receiving player.

VERSION 6

The method of play of this version is also basically the same as in Version 1. However, in this version, any chance bets would be made prior to the dealing of any cards. Thus, any chance bets would also be made at the same time as usual bets. As the players would not be assured that any no value cards would be dealt during usual play, the payoff for winning of a chance bet would be increased compared to that of Version 1 to compensate for this increased risk to the player. Also, after a no value card and a subsequent card are dealt and any chance wagers settled, any subsequently dealt no value cards in that hand would be ignored and a new card immediately dealt to replace it.

VERSION 7

This version of the wagering game is also basically similar to the first version discussed above, but in this case a chance display area 46 is designated on surface 14. Then, when a no value playing card is dealt, the no value card is moved to chance display area 46 and the players are invited to make chance bets. The next card dealt is then also placed in the chance area for all players to see with ease. If it is not another no value card, the playing card 16 is then given to the player who initially received the first no value playing card and all bets are collected by the dealer or house. In this version, there is only a payoff as indicated in indicia 31, and thus pot 26' of tokens 26 in indicia 42 is omitted in this version. If a second no value playing card is dealt, payoffs are made as indicated in indicia 31.

By way of example in this version, where six standard decks of playing cards 16 are used, there can be four gold no value playing cards 28, twelve silver no value playing cards **20*b***, and twenty bronze no value cards mixed together with the six standard decks. In this example, a suitable payoff value would be: for two gold no value playing cards, 25 to 1; for two no value silver playing cards, 20 to 1; for two bronze no value playing cards, 10 to 1; and for any two no value playing cards of any color, 3 to 1. For the four payoff occurrences, the odds are, respectively, 1,040 to 1; 93.64 to 1; 31.87 to 1; and 15.97 to 1. Where the house retains all losing bets, the house whole percentage would be 18.28 while the player return percentage would be 81.72.

VERSION 8

The method of play of this version is also basically similar to that of Version 1 above. However, in this embodiment, if the dealer receives a first no value playing card, the players can make chance wagers as desired. However, the payoffs for the chance wagers will be limited to that indicated by indicia 31. Thus, there will be no possibility of any of the players winning pot 26' of tokens 26 in indicia 42.

VERSION 9

The method of play of this embodiment of the wagering game according to the present invention can use any of the versions mentioned above. In addition to the use of the additional no value playing cards, association wagering means 32 is further utilized. To use association wagering means 32, at the same time that a usual 21 bet is made by placing a token on usual wagering means 22, an association bet is also made by using association wagering means 32 and placing one or more tokens 26 thereon. The association wager is that the first two cards dealt to that player will have a predetermined association. In the embodiment of association wagering means depicted in FIG. 2, the predetermined association is indicated by indicia 31. This predetermined association and associated pay off is that the first two cards are of the same suit. As an added bonus, an additional payoff is made if the two cards are not only of the same suit, but are also (or alternatively, if desired) a king-queen combination. Thus, after the first two cards are dealt to each player, the dealer then immediately settles any association wagers according to the payoff indicated in indicia 31.

As another embodiment of this version, it is also possible for the house or dealer to contribute one-half of all losing association wagers to a separate association pot 48 of association settling means 44 provided in indicia 50. Association pot 48 would be used to pay off a winner of a king-queen combination of the same suit from what should be an increasingly valued pot of tokens. The house or dealer could guarantee a minimum amount in association pot 48 for the occasions after association pot 48 is paid out and before a minimum amount is collected and placed therein by losing association wagers. If desired, the kings and queens of the decks of cards 16 can also be specially designated to facilitate the ready recognition thereof and to indicate that these cards are used with association wagering means 34 to help stimulate interest in association wagering means 34.

While playing system 10 has been illustrated with use of the 21 or blackjack usual card game, it should be appreciated that various other usual card games can also make use of chance wagering means 28 and association wagering means 32. Thus, card games such as poker, baccarat, and pai gow can incorporate no value playing cards and the various versions of the 21 or blackjack game discussed above adapted for use with these other games. By way of further example, the following additional versions of a wagering game are discussed hereinafter.

VERSION 1

For a casino table game stud poker version, the display means would be essentially similar to display means 12. Then, during any of the versions of stud poker as each card is dealt the receiving player or dealer must immediately check each down card. If a no value card is received, the card is then moved to a central area and regular poker play is suspended while chance wagers are made and settled. If the no value playing card initially received was a down card, then the subsequent card dealt will also be a down card and the dealer must check it upon dealing. If the subsequent card is another no value playing card, the card is turned over and winners paid accordingly. However, if the subsequent card is a regular playing card, the regular playing card is then passed to the player without revealing it to the other players.

VERSION 2

In the draw poker version of a method of playing a wagering game according to the present invention, all players will make a usual wager prior to dealing and a chance wager also at that time if desired. Subsequently, if a player has not made a chance wager, any no value card received by that player is simply replaced by the dealer.

However, if the receiving player had already placed a chance wager, the following would occur. If the receiving player is dealt only one no value playing card, it will be considered as a "joker". In "high" draw poker, the single no value playing card is used only as an ace or a fill-in card in straights and flushes. However, in "low" draw poker, the single no value playing card is used as a fill-in card. Obviously, other variations on this theme can be designated by the house or rules. If the player is dealt two or more no value playing cards, the receiving player must then redeem two of these no value cards immediately and the chance wager will be settled according to posted payoff schedules (including color match, etc.). Two new cards will then be dealt to replace the two no value cards turned in. After turning in the first two no value playing cards, if the player still has remaining no value playing cards, a single remaining no value playing card is then used as a "joker" or two remaining no value playing cards are then turned in and settled as a separate successful chance wager. After all no value playing cards have been redeemed, the usual betting and draw rules are then followed. During the draw, the above rules apply when a further no value playing card is received. At the end of the hand, any chance wagers remaining for players who did not receive two no value playing cards are then collected by the house (and optionally one-half provided to a pile for a chance settling means pot).

For a home version of such a game, it is anticipated that there would be no house dealer, and all players would deal in turn. In this event, all chance wagers which are lost would be placed into a chance settling means. The chance settling means would also require an "ante" when the game is first started or after the pile of tokens in the chance settling means has been won. Where color no value cards are used, different percentages of the chance settling means would be won depending upon the presence and color of matches.

The various versions discussed above are also applicable to a usual baccarat card game. In one preferred embodiment, the usual baccarat game would be played until a no value playing card is dealt. This card would then immediately be moved to a display area and chance wagering would occur by any player desiring to do so. If another no value card is next dealt, all players making chance wagers would be winners and such wagers settled by the dealer. In addition, if the receiving player has made a chance wager, the receiving player would also win at least some portion of a pot of tokens in a chance settling means in the same manner as described above.

In this version of a baccarat game, a receiving player may make a chance wager even if their usual baccarat wager is on an opposite hand. By way of example, there could be eight standard decks of playing cards to which is added: six gold no value cards, 14 silver no value cards, and 28 bronze no value cards. Exemplary payoffs would then be: for two gold no value cards, 25 to 1; for two silver no value playing cards, 10 to 1; for two bronze no value cards, 5 to 1; and for any two no value cards, 1 to 1. With such pay outs, a house hold percentage would be about 11% while the player return percentage would be about 89%.

As with the 21 game discussed above, it would also be possible to utilize an association settling means in a baccarat game in a similar manner as discussed above. Both wagers for any two cards of the same suit or for a higher payoff for the king and queen in a suit could be made as discussed above. In addition, a separate association settling means could be won by a player who makes an association bet and further wins that bet with a natural 9 using the two cards in the suit first dealt.

A wagering game according to the present invention could also include the usual game of pai gow poker. In such a game, all cards are dealt face-up, so the method of play would be similar to that described above for 21 or blackjack. In a preferred embodiment of a pai gow game according to the present invention, essentially the same rules as described above with respect to version 8 of a 21 game would be used.

For home versions of any of the above wagering games, an appropriate playing system would be provided. Such a system would include a table layout, a tray of assorted wagering chips or tokens, and two decks of playing cards including an appropriate number and type of no value playing cards. In addition, for convenience, a number, such as one dozen, of Velcro-backed chance wagering means and association wagering means in the forms of circles with suitable indicia thereon would be provided to be attached to the table layout in front of each player. A set of appropriate rules for the home version game would then also be provided.

Figure 3:
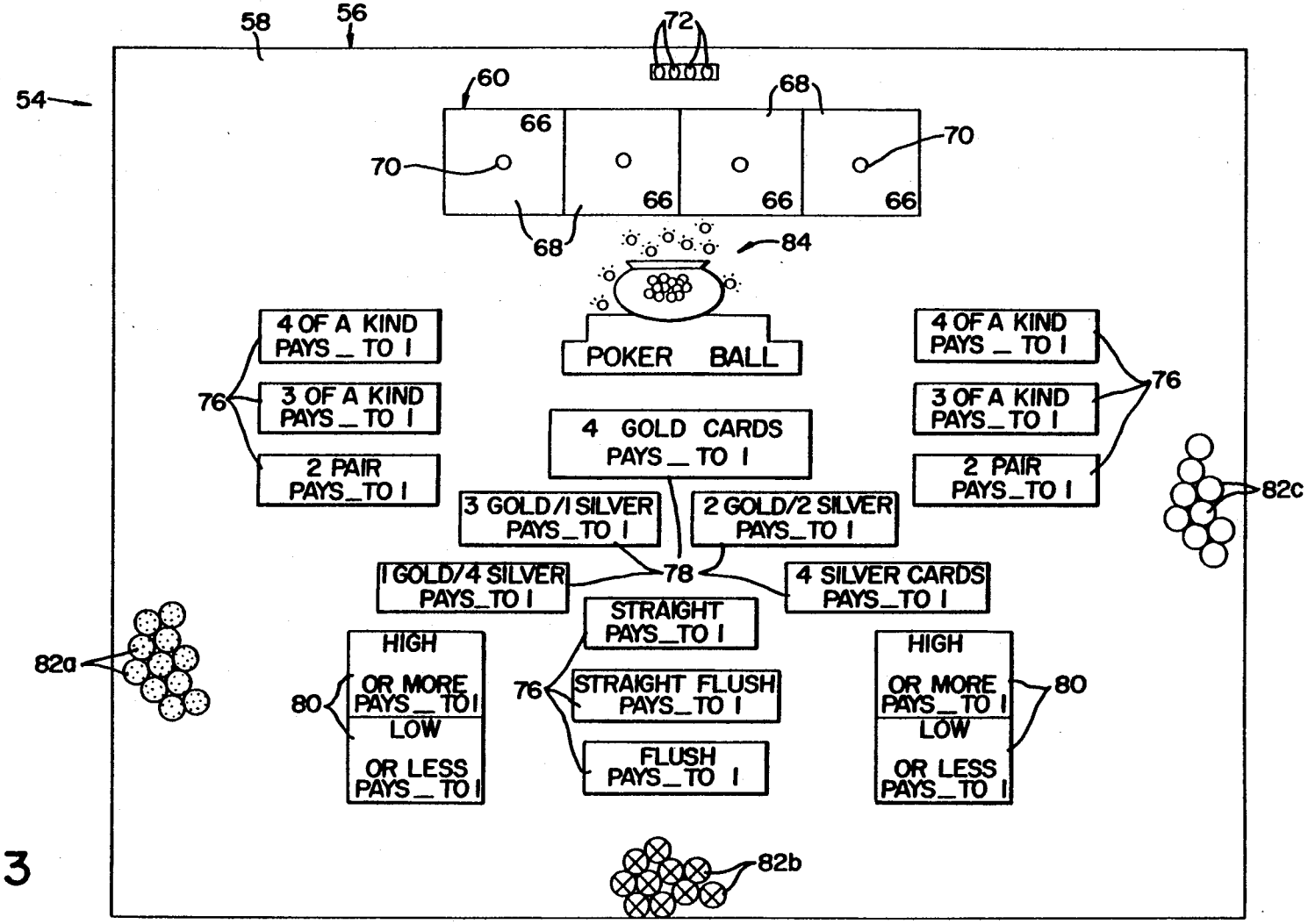
FIG. 3 is a schematic representation of a display device for a poker ball wagering game of the present invention.
Figure 4:
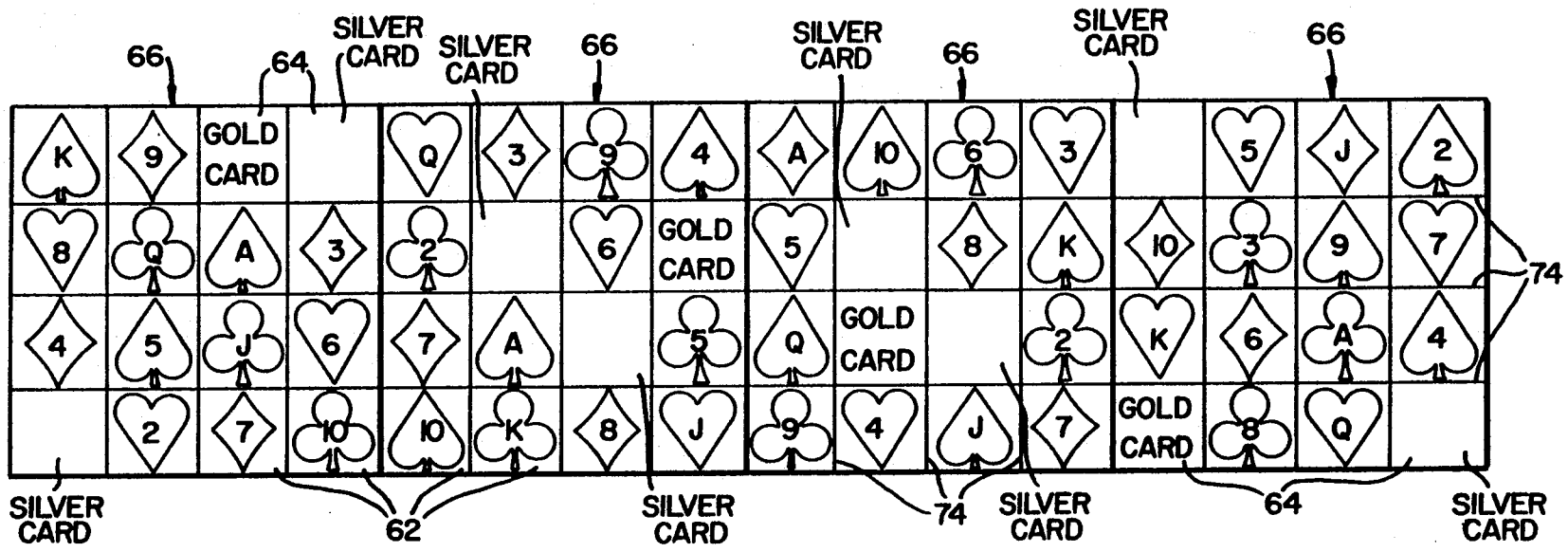
FIG. 4 is an enlarged view of the symbols contained in the box of FIG. 3 and omitted therein for clarity.

Depicted in FIG. 3 is a second embodiment of a wagering game according to the present invention including a playing system 54. Playing system 54 includes a display means 56 having a surface 58. This wagering game is similar to a poker card game, but instead of playing cards, there is a selection device 60 whereby representations 62 of usual playing cards as depicted in FIG. 4 are selected. As shown, there are also representations 64 of no value playing cards as well. Selection device 60 in this embodiment includes a series of clear boxes or containers 66 having tops 68 in which a single aperture 70 is provided. As there are four containers 66, four balls 72 are also provided with playing system 54. It will thus be appreciated that in playing the wagering game, a ball 72 is dropped through each aperture 70 of selection device 60. Then, because representations 62 and 64 are formed on a hard surface with borders 74 therebetween, each ball 72 in a container 66 will bounce around and finally come to rest upon (randomly select) one of representations 62 or 64.

As shown in FIG. 3, surface 58 includes various indicia 76 whereby a usual wager is made on the outcome of the representations 62 selected by the dropping of balls 72 into container 66. As mentioned above, this game is similar to poker and thus some of the poker-type hands can be bet on with different payoffs depending on the difficulty of selecting such a hand. It will be appreciated that in this wagering game, there are only four containers and thus only four representations selected.

In addition to the usual wagering means provided by indicia 76, chance wagering means in the form of indicia 78 are further provided. Indicia 78 also is similar to the chance wagering means described above, with the occurrence of various representations 64 generating different payoffs depending upon the difficulty of obtaining such combinations or representations.

Finally, an association wagering means in the form of indicia 80 is further provided. In this embodiment, the association is the sum of the selected representations 62 (and 64, but having no value these can be ignored). Depending upon the number value of representations 62 selected, a predetermined payoff can be obtained if the sum of the number values of representations 62 is above a certain "high" value or less than a certain "low" value.

With playing system 54, all of the players utilize the same indicia 76, 78, and 80. For that reason, playing system 54 also includes different kinds of tokens such as tokens 82*a*, 82*b* and 82*c*. Thus, the wager that each player makes is identified by his particular variety of token, and any winning wagers must therefore be settled in a similar token which would be maintained by the dealer or house.

The method of play of the wagering game of playing system 54 is, obviously, subject to a number of versions as described above with respect to the other games. In one preferred embodiment, the method of play would be as follows. At the start of each game, all players are given an opportunity to place a bet on one or any number of indicia 76, 78 and 80. After the bets are made, balls 72 are dropped into respective containers house or dealer such that a representation 62 or 64 in each container 66 is randomly selected when balls 72 come to rest thereon. Depending on the various representations selected, the various wagers of the players are settled either by collection of the losing wagers or paying off of winning wagers by the dealer or house. Thereafter, a new game is commenced with the players making any wagers desired.

As with other versions of a wagering game described above, a separate chance settling means 84 can be provided in which half of all losing chance wagers are placed to form a pot which can be won by a preselected bet such as the appearance of four gold no value cards. In case of ties, the pot would be split amongst the bettors.

Playing system 54 is also easily adapted for a home version in a manner similar to that described above for other wagering games.

Figure 5:
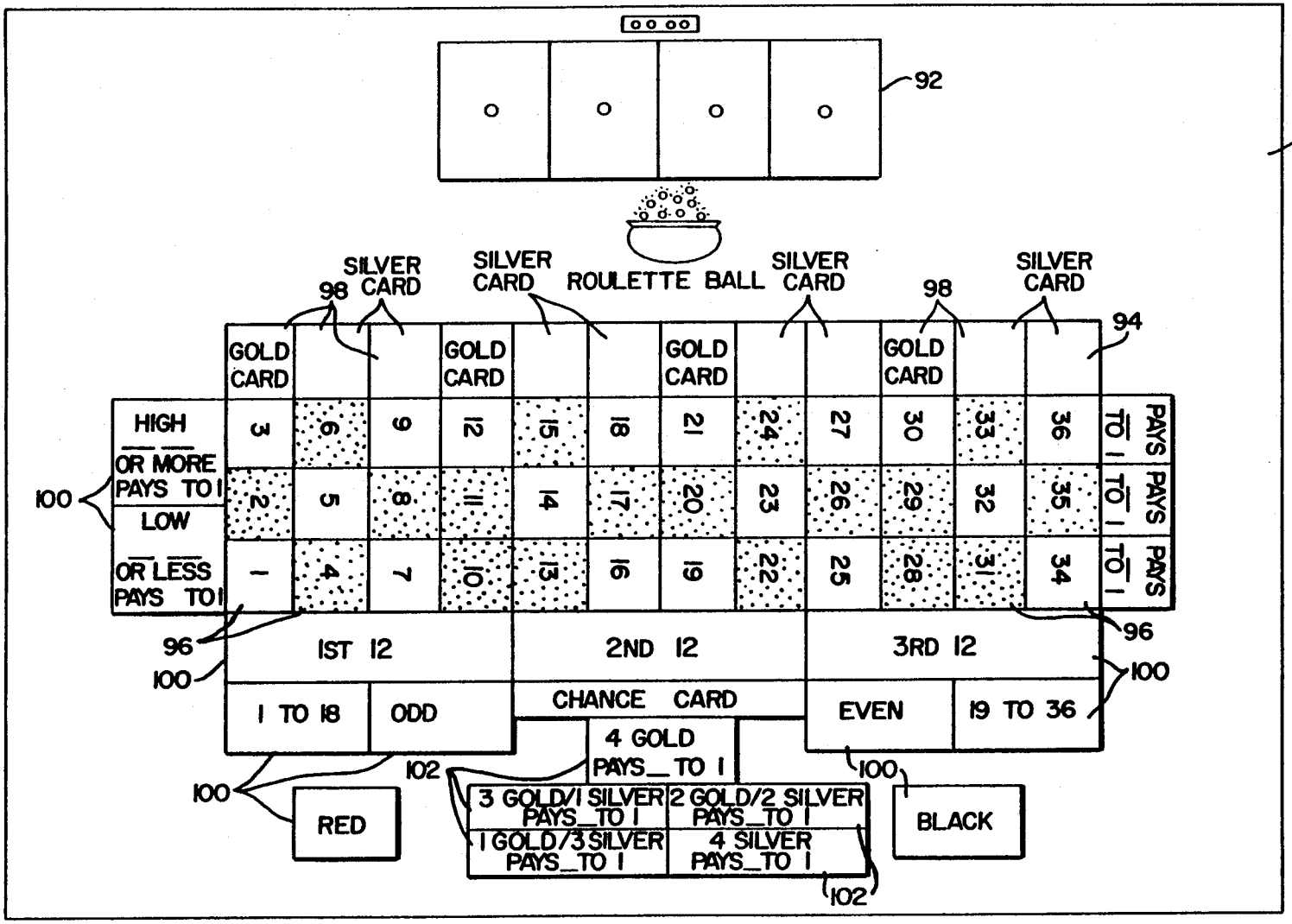
FIG. 5 is a schematic representation of a display device for a roulette ball wagering game of the present invention.

Depicted in FIG. 5 is a playing system 88 which is broadly similar to playing system 54. Playing system 88 is for a game similar to a ball roulette. Playing system 88 thus includes a surface 90 on which a clear selection device 92 is provided having representations therein (not shown) which are laid out in the same manner as a grid 94 provided on surface 90. Grid 94 thus includes similar representations 96 corresponding to the usual numbers of a usual roulette ball game as well as representations 98 for no value "cards" or selections in the colors noted. It should also be appreciated that representations 96 of the numbers also show red and black colors, with the black colors appearing as shaded in FIG. 5.

Surrounding grid 94 is various indica 100 forming usual wagering means for the outcome of representations 96 of the usual numbers. In addition, indicia 102 is further provided for wagering on the chance selection of a plurality of indicia 102 representing no value cards.

As with playing system 54 discussed above, playing system 88 is used in a similar manner. Thus, at the start of each game, new players are given the opportunity to place the various bets or plurality of bets as desired using indicia 100 and 102. To distinguish each player, each player has different colored wagering chips or tokens. Then, at the end of each game, the various bets are settled as required. As with playing systems 10 and 54, a chance settling means 104 can also be provided containing half of all of the lost chance wagers from previous games. The pot contained in chance settling means 104 would be won by a bet of four gold cards.

Figure 6:
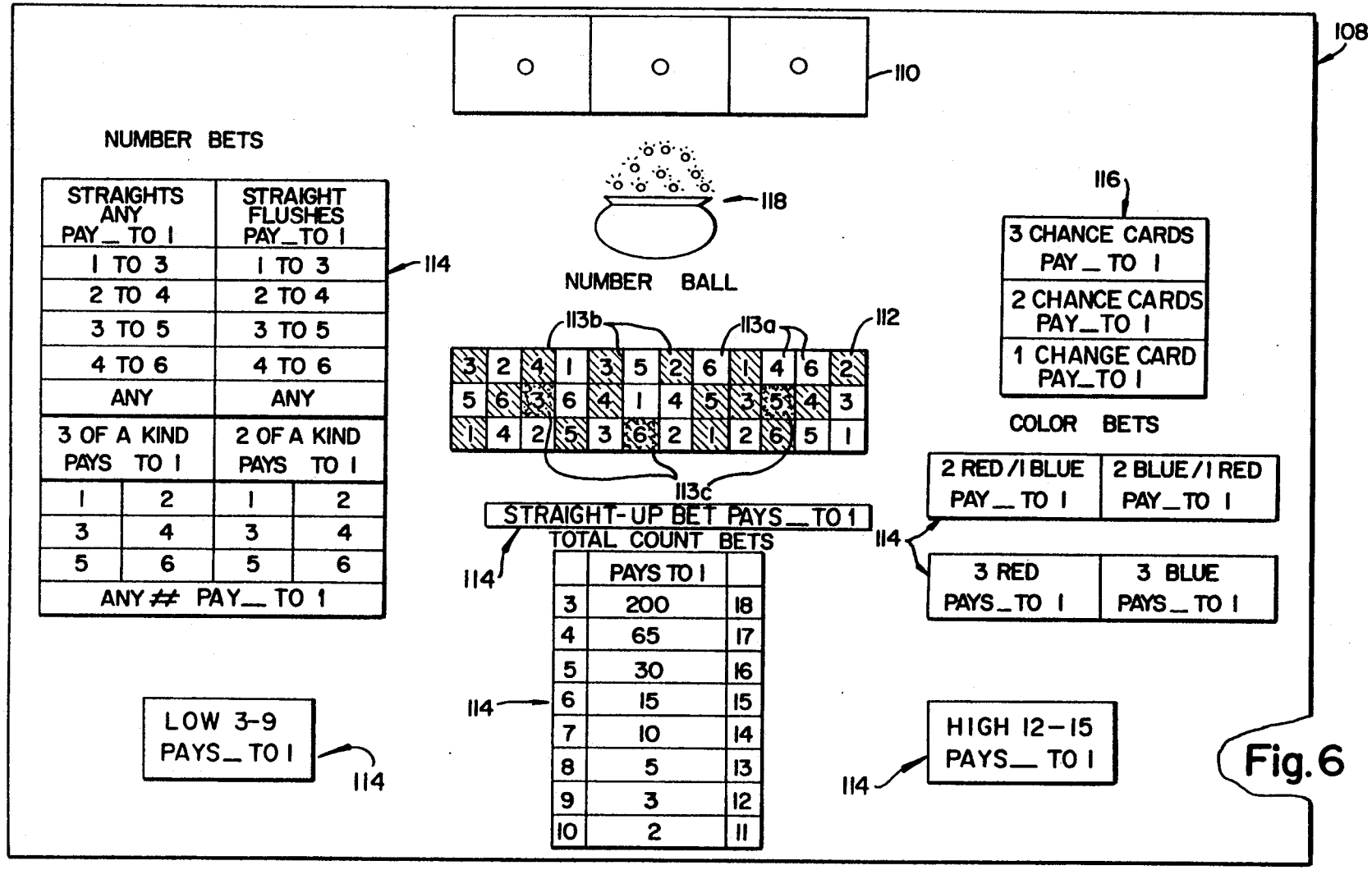
FIG. 6 is a schematic representation of a display device for a number ball wagering game of the present invention.

Depicted in FIG. 6 is another playing system 108 for an alternative wagering game according to the present invention. This wagering game is based on the selection of certain numbers or "cards" in a clear selection device 110 containing representations of numbers (not shown) as shown in grid 112. As shown in grid 112, various numbers are individually represented, and additionally various numbers are color-coded as red or blue (in grid 112, red numbers are represented by plain squares 113*a* while blue numbers are represented by squares 113*b* having diagonal lines therein). In addition, certain squares 113*c* in each 3×4 matrix of a container are also designated as chance "cards" or numbers. In grid 112, these chance numbers are represented by numbers surrounded by dots, though in an actual grid these numbers would probably be colored gold or some similar color.

It will thus be appreciated that playing system 108 includes indicia 114 for various usual number bets, many of which in this case are similar to poker bets, though without any face cards or suits but including colors. Other bets include the totals of the selected numbers being between certain LOW values or between certain HIGH values. Similarly, an indicia 116 is provided for a chance wagering means, which can pay off if one or more chance cards are selected as indicated.

The method of playing the wagering game of playing system 108 is basically the same as described above for playing systems 54 and 88, and a chance settling means 118 may also be provided.

Figure 7:
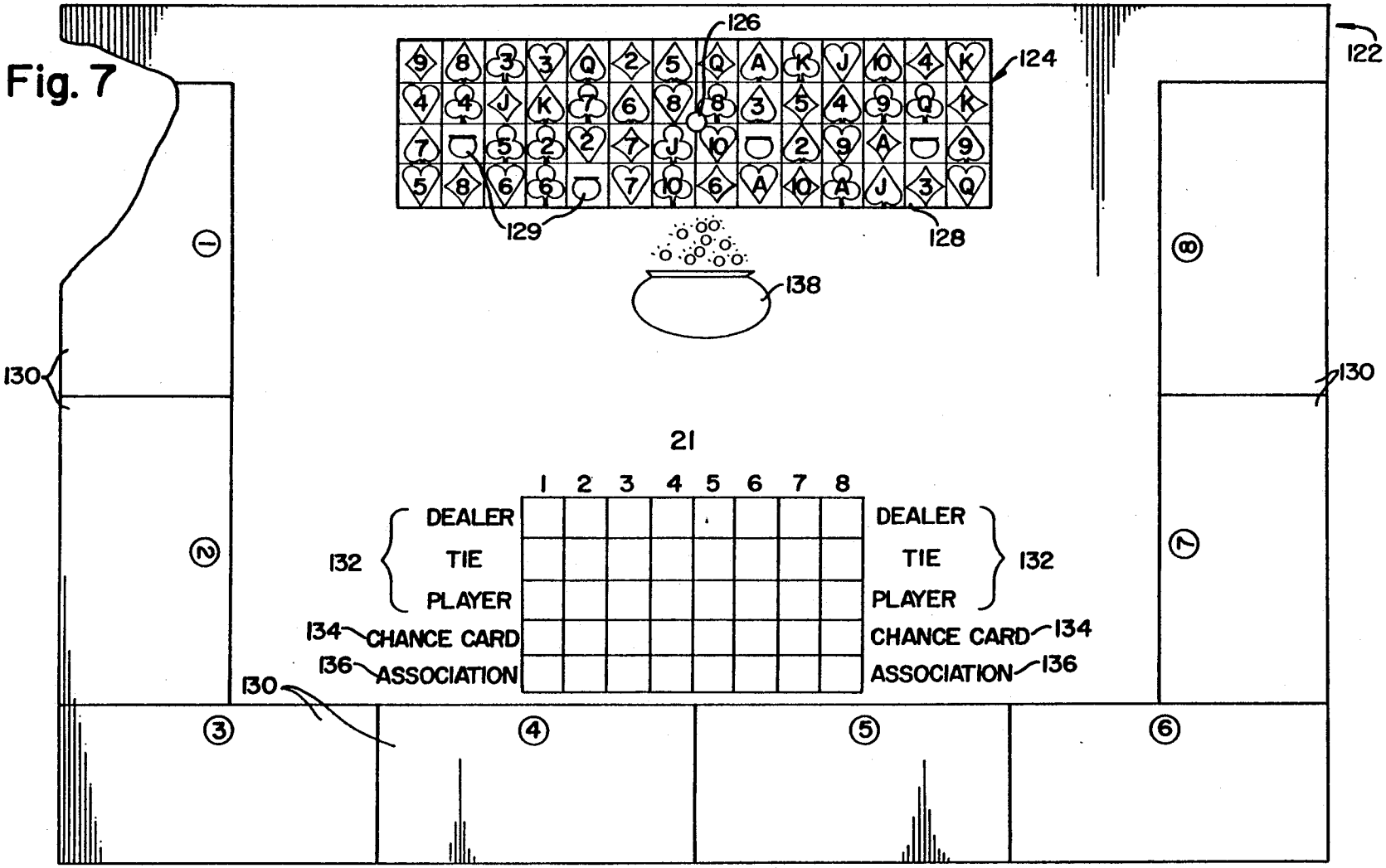
FIG. 7 is a schematic representation of a display device for a 21 ball wagering game of the present invention.

Depicted in FIG. 7 is a playing system 122 which utilizes a selection device 124 similar to the selection devices described above. Selection device 124, however, has a single aperture 126 through which balls (not shown) are sequentially dropped to represent the dealing of cards from a deck of usual playing cards as indicated in grid 128 located in selection device 124. Playing system 122 includes areas 130 for eight players to sit adjacent as well as an area for the dealer behind selection device 124.

Playing system 122 makes use of the usual game of 21, but in playing system 122 the game is only between a house dealer and a single "house" player who may or may not be designated. Balls are sequentially dropped into selection device 124 to represent the dealings of cards to the house player and the house dealer, in the usual manner of 21 play. In playing system 122, it will be appreciated that the house player is required to select a hit card should the total of the first two cards be below a predetermined minimum (for example 15) and that the house dealer is similarly be required to select an additional card should the dealer's total be below a predetermined minimum (for example 16). If desired, one of the eight players can be selected for each hand to drop the house player's balls or all of the balls as desired. Alternatively, all players can sequentially drop the balls, or just the player's balls.

Before each hand, the players can bet on the three possible outcomes of a hand as indicated by indicia 132. These outcomes are that the house dealer wins, that there is a tie, or that the house player wins. Different rows are provided for each player to make a bet, and for convenience each player can also be provided with different color chips to distinguish that players' bet from other players' bets. In addition, each player can also bet on whether two chance cards 129 will be selected consecutively as indicated at indicia 134 and additionally bet on whether a predetermined association (such as a same suit) will occur with the first two house player cards selected by use of indicia 136. Obviously, the various versions of a 21 or blackjack game discussed above for use with the present invention are also applicable to playing system 122, including a chance settling means 138.

Figure 8:
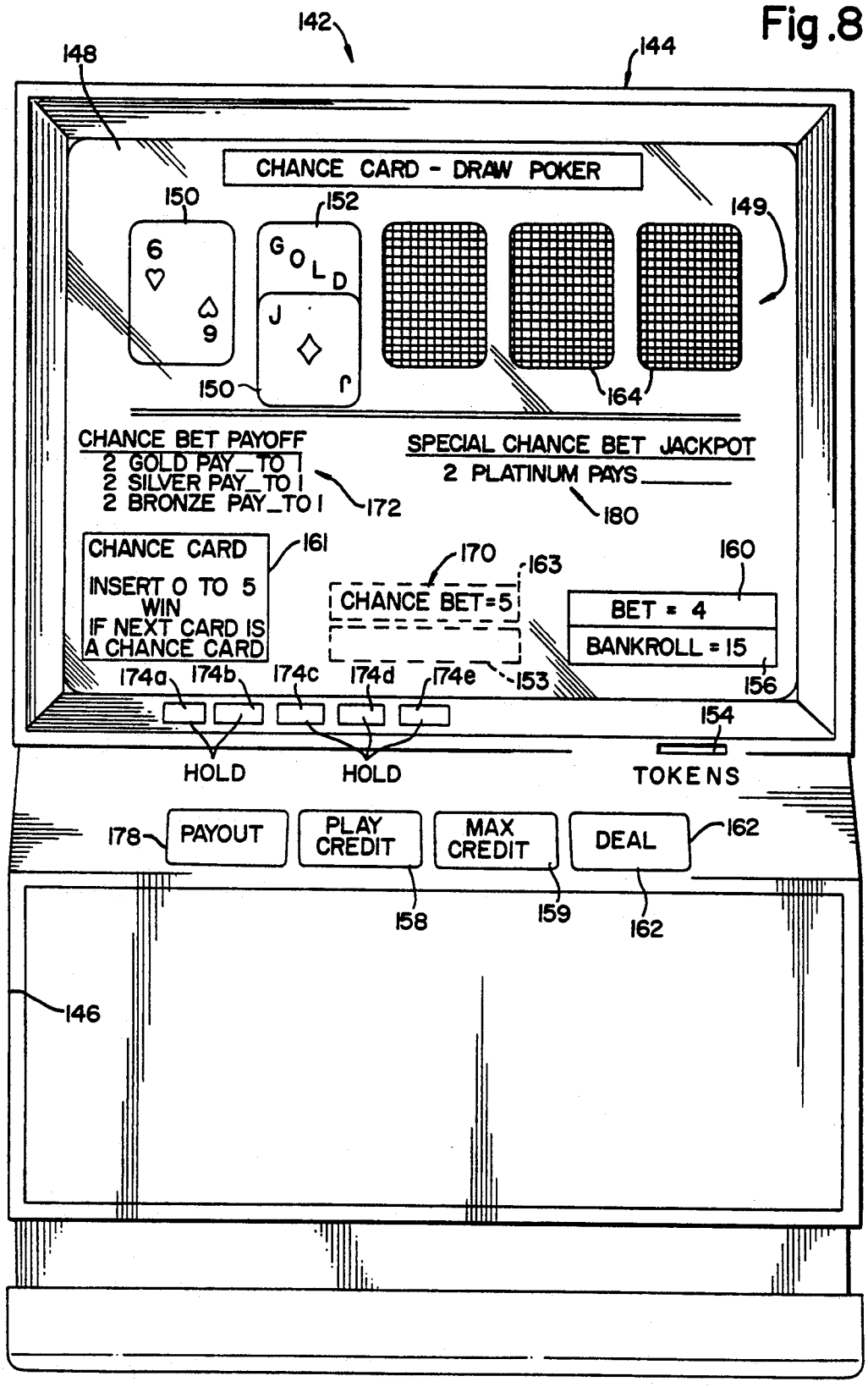
FIG. 8 is a front plan view of an electronic wagering game of the present invention.

Depicted in FIG. 8 is a playing system 142 which includes a display means 144. Display means 144 is an electronic game device 146 having a video display screen 148. In playing system 142, the object of the game is to obtain a poker hand shown in a hand display 149 of predetermined values which have predetermined payoffs. Thus, the usual symbols are representations 150 of usual playing cards of a deck. If desired, game device 146 can electronically mix a number of decks together, so that it is possible to even obtain five of a kind. In addition, a plurality of chance cards are also electronically mixed with the usual playing cards. In this embodiment, the chance cards come in four different colors, as shown by representation 152 of a gold card.

In order to play a hand with game device 146, the following steps are taken. Initially, in an attract mode after a hand has been played, the words "INSERT COIN" appears in an instruction area 153 of display screen 144. This is an invitation to feed from one to five tokens into game device 146 through suitable wager receiving means 154. After five tokens are received in wager receiving means 154, the game will automatically start. If it is desired to wager less than five tokens, then after the desired number of tokens are inserted in wager receiving means 154, deal button 162 is pressed to start the game.

Alternatively, if credits are already present in a suitable registering means including an indicia 156 on display screen 148 (which shows a "bankroll" credit of 15), one or more credits is transferred to usual bet indicia 160 by depressing play credit button 158 and then deal button 162. As shown in FIG. 8 in indicia 160, a usual bet of four credits has been made. For convenience, if it is desired to wager the maximum number of credits, five in this example, max credit button 159 is simply depressed to transfer five credits from bankroll indicia 156 and this also automatically starts the game. It should be appreciated that indicia 156 thus serves to indicate the number of credits left, and serves as an indication of winning wagers which are credited or registered to this bankroll.

After a hand of playing system 142 is initiated by placing a usual bet and pressing deal button 162 (if necessary), representations 164 of the backs of the cards in hand display 149 are turned over one after another to a usual card representation 150 (shown in the first spot) or a chance card representation such as gold card representation 152 (shown partially in the second spot). Conveniently, this proceeds from left to right automatically, unless a chance card is dealt (as shown in the second card dealt in FIG. 8).

When a chance card is dealt, an invitation (such as "CHANCE CARD—INSERT 0 TO 5— WIN —IF NEXT CARD IS A CHANCE CARD—PRESS DEAL TO PLAY") to make a chance bet appears in instruction area 161. The player is then given an opportunity to place a chance bet in chance bet area 163 which then appears with the indicia "CHANCE BET". Where the player already has available credits as indicated in indicia 156, this is done by depressing either play credit bet button 158 a number of times as desired for the number of credits to be registered for a chance bet or by simply depressing max credit bet button 159 for an automatic bet of five credits. If no credits are available or an insufficient number, the player then simply inserts the desired number of tokens in wager receiving means 154.

Where max credit bet button 159 is depressed or five tokens are inserted in wager receiving means 154, a new card is immediately dealt on top of and somewhat below (i.e., overlapping) the chance card as shown. Otherwise, this action is instead initiated by depressing deal button 162 if play credit button 158 is used or less than five tokens are inserted into wager receiving means 154. If no chance bet is desired, then the player simply depresses deal button 168 without making any bet.

As shown in FIG. 8, a chance bet of five credits was registered by a suitable registering means including indicia 170, so that the next card was automatically dealt overlapping gold chance card 152. This next card was a usual playing card 150 (in this case the jack of diamonds). Consequently, instruction area 161 then displayed "SORRY—NO MATCH THIS TIME—PRESS DEAL TO PLAY". Then, after deal button 162 is pressed, the usual playing card 150 will take the place of gold chance card 152 at the second spot and the loss of the chance bet as shown in chance bet area will occur as the chance bet indicia 170 disappears. The deal of the remainder of the cards 164 then continues, unless another chance card is displayed in which case the above steps are then repeated.

If a chance card of the same color had appeared, a payoff as indicated by indicia 172 would have been made. This would have been initially indicated by the words "CHANCE CARD—YOU HAVE A MATCH—PRESS DEAL TO PLAY". When deal button 162 was then pressed, the chance bet indicated in indicia would have disappeared and the appropriate number of credits would have been registered in the registering means and the new number of credits displayed in bankroll indicia 156. After this was accomplished, a new card would be dealt in place of the two overlapping chance cards in the second spot.

After five usual card representations 150 have been obtained, the player then has the opportunity to be dealt new cards for each one of the original five received. Each one of the cards represented in hand display 149 optionally held or replaced as desired by the player. This is conveniently indicated in instruction area 161 by the words "HOLD (0) TO (5) CARDS AND PRESS DEAL. OTHER CARDS WILL BE REPLACED". If it is desired to hold the card, the corresponding hold button 174*a*, 174*b*, 174*c*, 174*d*, and 174*e* is simply depressed.

After the desired selections are made, deal button 162 is simply depressed and the cards which are not to be held are replaced (dealt anew) one at a time is continued until all cards represented in hand display 149 have been held or dealt again. Obviously, any time that a card is dealt and that card is a representation 152 of a chance card, the process of providing an opportunity to make a chance bet is repeated. After the last card representation in hand display 149 has been held or dealt anew and the hand provided in hand display 149 is set, game device 146 determines the value of the hand in hand display 149. A payoff as indicated by suitable indicia appearing in instruction area 161 is then made, either by removing the bet total from bet indicia 160 or providing credits to bankroll indicia 156.

If the player desires to play again, a usual bet is then made to start a new hand. Otherwise, the player presses a payout button 178 and game device 146 makes a suitable payout such as by tokens or a receipt.

To further interest in chance betting for casinos and the like, a progressive chance jackpot can also be provided, such as indicated by indicia 180. The value for the progressive chance jackpot would preferably come from a percentage of each losing chance bet made on the particular game device, as well as other such game devices located in the casino. All of these game devices would be electronically connected together, and the increasing value of the progressive chance jackpot would be displayed in indicia 180. In order to win such a progressive jackpot, two platinum chance cards (not shown) could be added to the six or more decks of usual playing cards electronically mixed in game device 146. Then, a progressive jackpot would be won when the two platinum chance cards are consecutively dealt and a chance wager is made.

While various playing systems and variations have been described above, it will be appreciated that many of the variations of one playing system would be adaptable to others of the described playing systems. In addition, as obvious to those of ordinary skill in the art, numerous other playing systems besides those described above and in particular numerous other games could incorporate the basic methods of play and the various variations described.

Figure 9:
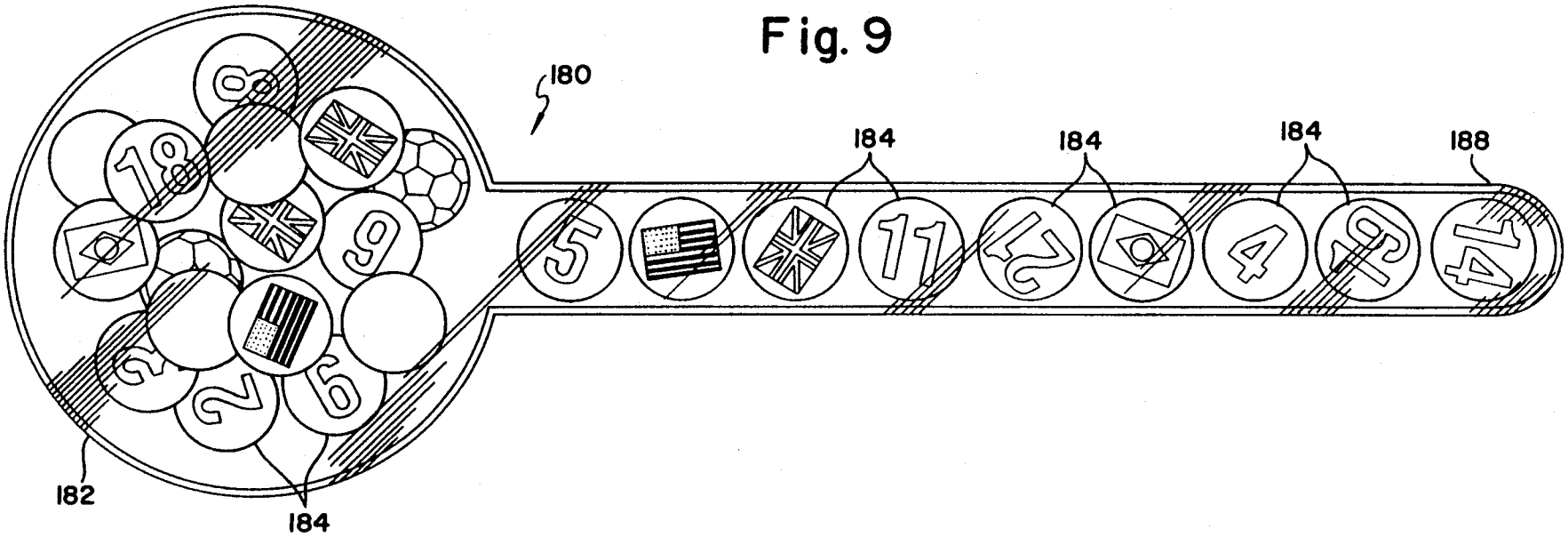
FIG. 9 is a schematic view of an air ball device for use in a lottery game in accordance with the present invention.

For example, various lottery games such as those where a plurality of numbers are selected could be adapted to incorporate additional chance symbols according to the present invention. Shown in FIG. 9 is a playing system 180 which is usable with such lottery games. Playing system 180 includes a mixing chamber 182 in which a plurality (such as fifty) of usual (value) balls 184 are mixed by blowing air, as well known in the art. In this embodiment, usual balls 184 have different indicia thereon, including numbers as well as flag symbols of different countries. Obviously, the choice of symbols used on usual balls 184 is arbitrary and is made for convenience or as desired by the lottery owner.

Added to usual balls 184 in mixing chamber 182 is one or more additional chance (no value) balls 186; in this embodiment three additional chance balls 186 are used. Chance balls 186 are designed to look like soccer balls. While the selection of the symbols for chance balls 186 is also arbitrary, it will be appreciated that balls 184 and 186 could be used in a lottery which would generate interest in countries interested in World Cup soccer or the like.

In use, playing system 180 is used to select a certain number of balls 184 and/or 186. Selection is accomplished by use of a transparent tube 188 which is selectively connected to mixing chamber 182, as also well known to those in the art. In this embodiment of playing system 180, the lottery winner is based on a player choosing six usual balls 184 of all of those selected.

Thus, to assure that six usual balls 184 are selected (in case all three chance balls 186 mixed in with the various usual balls 184 are also selected), tube 188 must be capable of holding nine balls. However, it will be appreciated that all usual balls selected determine the lottery winner (or winners).

In FIG. 9, nine usual balls 184 have been selected, so that various combinations of six balls 184 would determine the lottery winner(s). The winner(s) would win a usual prize, determined in advance according to schemes well known in the art.

Figure 10:
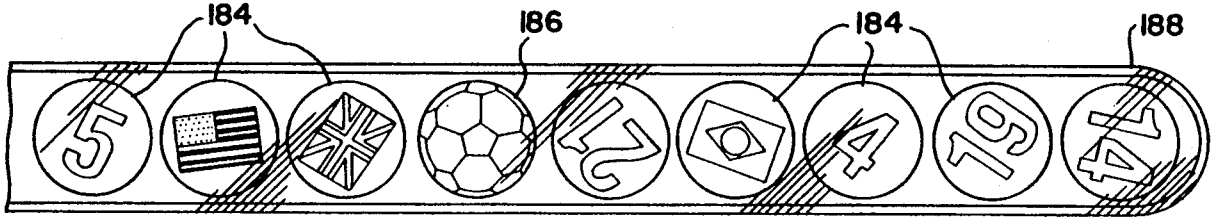
FIG. 10 is a schematic view of the tube portion of the ball device depicted in FIG. 9 with a different configuration of balls than in the FIG. 9.

In FIG. 10, while nine balls 184 and 186 have been selected, the group including the usual balls 184 includes a chance ball 186. In this situation, the choosing of any six of the usual balls 184 determines the lottery winner; and because a chance ball was included in this group, the winnings are (for example) doubled over that of the winner of the lottery when no chance balls are selected. However, it will be appreciated that the chances of a winner matching six of the usual balls is decreased, because there are only eight usual balls.

Figure 11:
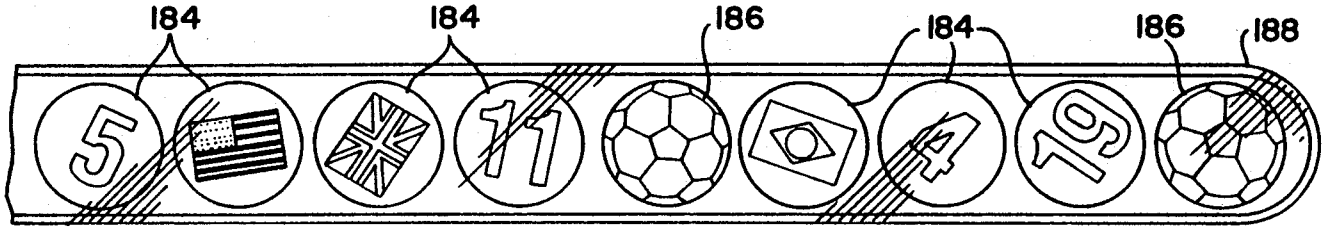
FIG. 11 is a schematic view of the tube portion of the ball device depicted in FIG. 9 with a different configuration of balls than in the FIGS. 9 and 10.

In FIG. 11, while nine balls 184 and 186 have been selected, the group including the usual balls 184 includes two chance balls 186. In this situation as well, the choosing of any six of the usual balls 184 determines the lottery winner. However, because the two chance balls 186 were included in this group, the winnings are (for example) five times that of the winner of the lottery when no chance balls 186 are selected (as the chances of a winner are further decreased).

Figure 12:
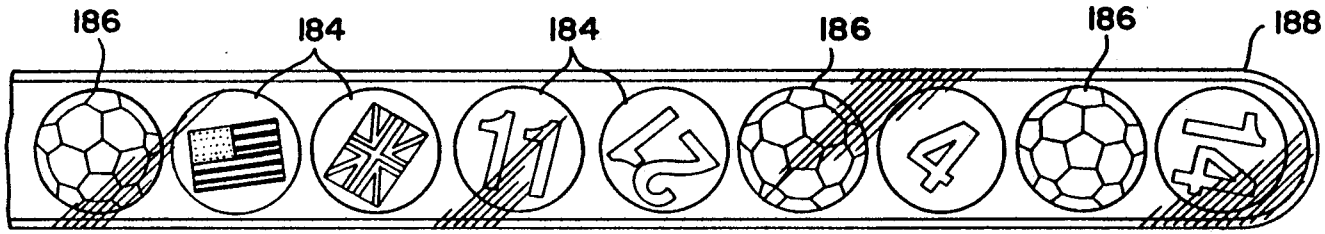
FIG. 12 is a schematic view of the tube portion of the ball device depicted in FIG. 9 with a different configuration of balls than in the FIGS. 9, 10, and 11.

In FIG. 12, the group including the usual balls 184 (four numbered and two flags) is the entire tube 188 as this group includes three chance balls 186. In this situation as well, the (and only) six usual balls 184 determines the lottery winner. However, because the three chance balls 186 were included in this group, the winnings are (for example) twelve times that of the winner of the lottery when no chance balls 186 are selected (as the chances of a winner are still further decreased).

While the winnings of the lottery using the six usual balls 184 has been described as being increased automatically whenever one or more chance balls 186 are selected, other variations are possible. For example, the lottery player could be required at the same time that the usual ticket is purchased to elect as well (if desired) for any chance payoff in accordance with whether there will be one (or more), two (or more) or three chance balls 186 in the selected group. A progressively increased purchase price would then be charged for each increased payoff chance, or a single increased price for any one of the chance selections.

As an alternative embodiment, chance wagers could instead provide an additional payoff where two no value (chance) balls are added to the usual balls and then selected during the course of selecting six (for example) numbered balls. This increased payoff could be made: for the selection of two no value balls consecutively, for the selection of two no value balls out of the total, or for both, with different payoffs for each possibility. It should be appreciated that where six numbers are required for a lottery bet, eight (six plus the number of chance balls) balls would be selected with the numbered balls determining the winning lottery combination. As an alternative, it could simply be decided that if two of the eight were also no value balls, the winnings could be doubled.

Obviously, other variations of a lottery game consistent with the description of the various playing systems above could also be possible, and other lottery games could be similarly adapted. Similar games such as bingo and keno could also be similarly adapted as desired. Numerous other apparatuses for selecting of the lottery symbols could also be used consistent with the present invention. Further, besides flags for symbols, to be used in addition to numbers or in lieu of numbers, various other symbols are possible. Still further, besides a soccer ball designation for a chance symbol, other symbols having a different significance are possible, such as a state symbol for use in a state lottery (e.g., a peach for Georgia, an orange for Florida, or an apple for New York).

Other examples of playing systems and games which could make use of the various methods of play and variations described above include reel slot devices and game shows.

Thus, while the present invention has been described with respect to exemplary embodiments thereof, it will be understood by those of ordinary skill in the art that variations and modifications can be effected within the scope and spirit of the invention.

What is claimed is:

1. A method of playing a lottery-type wagering game whose outcome is determined by a random selection of only some of a plurality of discrete lottery elements of that game comprising the steps of:

adding to the plurality of lottery elements at least one separate and discrete additional element;

playing of the game by at least one participant, including wagering a lottery wager on a chance occurrence of a selection of certain lottery elements during a play of the game including a selection of some ones of the lottery elements, wagering an additional wager on a chance occurrence of the at least one additional element being selected during the the selection of some ones of the lottery elements, and subsequent to said wagering steps, randomly selecting of some ones of al of the elements including a plurality of the lottery elements to determine an outcome of the game;

settling of the wagers of the chance occurrence of the additional element being included with the some ones of the elements selected; and settling of the wagers of the chance occurrence of the certain lottery elements being included with the some ones of the elements selected during the play of the game.

2. A method of playing a wagering game as claimed in claim 1 wherein said wagering a lottery wager step includes the step of choosing of a set number of the discrete lottery elements; and wherein the selecting step includes the selecting of the set number plus the number of additional elements available to be selected.

3. A method playing a wagering game as claimed in claim 2 wherein the adding step includes the step of mixing into the lottery elements at least two discrete additional elements; and wherein the wagering the additional step includes the wagering on whether two additional elements will be selected.

4. A method of playing a wagering game as claimed in claim 2 wherein the participants of the game include at least one player and a house against which each player wagers; and wherein the settling steps are performed by the house.

5. A method of playing a wagering game as claimed in claim 1 wherein the lottery elements are game pieces which are identically shaped and have different indicia thereon, and wherein said adding step includes the adding of at least one additional game piece which is identically shaped to the lottery game pieces as the additional element to a group formed from the lottery game pieces.

6. A method of playing a wagering game as claimed in claim 1 wherein the outcome of the wagering game is determined by the selection of a plurality of lottery elements, and wherein said selecting step includes the step of selecting a further lottery element for each additional element selected.

7. A method of playing a lottery-type wagering game whose outcome is determined by a random selection of a set number of discrete lottery elements of that game randomly from a group discretely containing each of the lottery elements comprising the steps of:

adding to the group of lottery elements at least one separate and discrete additional element;

playing of the game by at least one participant, including wagering a lottery wager on a chance occurrence of a selection of certain lottery elements during a play of the game including a selection of the set number of the elements including a plurality of lottery elements by a choosing of a plurality of certain lottery elements for the participant, wagering an additional wager on a chance occurrence of the at least one additional element being selected during the selection of the set number of elements from the group, and subsequent to said wagering steps, randomly selecting of the set number of the elements including a plurality of the lottery elements from each and every element of the group to determine an outcome of the game;

settling of the wagers of the chance occurrence of the additional element being included with the elements selected; and settling of the wagers of the chance occurrence of the certain lottery elements being included with the elements selected during the play of the game.

8. A method of playing a wagering game as claimed in claim 7 wherein said wagering a lottery wager step includes the step of choosing of a set number of the discrete lottery elements; and wherein the selecting step includes the selecting of the set number plus the number of additional elements available to be selected.

9. A method of playing a wagering game as claimed in claim 8 wherein the adding step includes the step of mixing into the lottery elements at least two discrete additional elements; and wherein the wagering the additional wager step includes the wagering on whether two discrete additional elements will be selected.

10. A method of playing a wagering game as claimed in claim 8 wherein the participants of the game include at least one player and a house against which each player wagers; and wherein the settling steps are performed by the house.

11. A method of playing a wagering game as claimed in claim 7 wherein the lottery elements are game pieces which are identically shaped and have different indicia thereon, and wherein said adding step includes the adding of at least one additional game piece which is identically shaped to the lottery game pieces as the additional element to a group formed from the lottery game pieces.

12. A method of playing a wagering game as claimed in claim 7 wherein said selecting step includes the step of selecting a further lottery element from the group for each additional element selected.

13. A method of playing a wagering game as claimed in claim 7 wherein said wagering an additional wager step includes the step of making the additional wager separate from the lottery wager.

14. A method of playing a wagering game as claimed in claim 7 wherein said wagering steps are performed by making a single wager.

* * * * *